US008626016B2

(12) United States Patent
Kawata et al.

(10) Patent No.: US 8,626,016 B2
(45) Date of Patent: Jan. 7, 2014

(54) IMAGE FORMING APPARATUS

(75) Inventors: Kentarou Kawata, Numazu (JP); Takuya Kitamura, Namazu (JP); Takayuki Kanazawa, Suntou-gun (JP); Yuji Kawaguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 376 days.

(21) Appl. No.: 12/969,381

(22) Filed: Dec. 15, 2010

(65) Prior Publication Data

US 2011/0150513 A1 Jun. 23, 2011

(30) Foreign Application Priority Data

Dec. 18, 2009 (JP) ..... 2009-288472
Sep. 14, 2010 (JP) ..... 2010-205833

(51) Int. Cl.
*G03G 15/06* (2006.01)

(52) U.S. Cl.
USPC ..... 399/55; 399/66; 399/119; 399/227

(58) Field of Classification Search
USPC ..... 399/55, 66, 119, 227
See application file for complete search history.

(56) References Cited

U.S. PATENT DOCUMENTS

| | | | | |
|---|---|---|---|---|
| 6,763,202 | B2 * | 7/2004 | Maeda | 399/53 |
| 6,845,222 | B2 * | 1/2005 | Takai | 399/88 |
| 7,215,904 | B2 * | 5/2007 | Hasegawa et al. | 399/111 |
| 7,366,430 | B2 * | 4/2008 | Shishikura et al. | 399/9 |
| 7,460,801 | B2 * | 12/2008 | Nishiyama | 399/44 |
| 2003/0091370 | A1 * | 5/2003 | Ono | 399/226 |
| 2004/0146316 | A1 * | 7/2004 | Yamada et al. | 399/227 |
| 2005/0141938 | A1 * | 6/2005 | Yoshizuka | 399/394 |
| 2007/0077092 | A1 * | 4/2007 | Wakahara | 399/227 |
| 2010/0303488 | A1 * | 12/2010 | Yanagi | 399/45 |

FOREIGN PATENT DOCUMENTS

| | | | |
|---|---|---|---|
| JP | 2005-148319 A | | 6/2005 |
| JP | 2007025412 A | * | 2/2007 |

* cited by examiner

*Primary Examiner* — David Gray
*Assistant Examiner* — Francis Gray
(74) *Attorney, Agent, or Firm* — Canon U.S.A., Inc., IP Division

(57) ABSTRACT

A charge bias causing the surface potential of a photosensitive drum to be lower than that in image formation is applied to a charge roller during a period in which the stop position of a rotary is moved from an unknown state to a home position to cause a developing bias to be applied to a developing roller to be smaller than that in the image formation.

13 Claims, 10 Drawing Sheets

IMAGE FORMING APPARATUS

BACKGROUND OF THE INVENTION

1. Field of the Invention

The present invention relates to a color electrophotographic image forming apparatus adopting a rotary developing process.

2. Description of the Related Art

Full-color image forming apparatuses each including a single image bearing member and a rotatable support integrally supporting multiple developing units are heretofore known. The full-color image forming apparatuses adopt a developing process in which the developing units are sequentially switched at certain timing to develop an electrostatic latent image formed on the surface of the image bearing member.

Such an image forming apparatus that uses a rotatable developing unit support (rotary) integrally supporting multiple developing units and that sequentially switches the developing units to develop an electrostatic latent image on the surface of a single image bearing member is referred to as a rotary image forming apparatus.

Japanese Patent Laid-Open No. 2005-148319 discloses the structure of a rotary image forming apparatus in related art. In general, in a developing process using a rotary (hereinafter referred to as a rotary developing process), it is necessary to perform an operation in which developer bearing members in the developer units corresponding to developer of the respective colors are sequentially in contact with and isolated from the surface of the image bearing member at a developing position. The switching of the developing units is performed by the developing unit support that rotates while the developing units are isolated from the surface of the image bearing member.

The image forming apparatus in the related art adopts a structure in which the developing unit support is moved in the radial direction (the direction of the center of the rotation) of the image bearing member by using, for example, a cam having a driving force to bring each developer bearing member in contact with the surface of the image bearing member or isolate each developer bearing member from the surface of the image bearing member.

However, the rotary image forming apparatus in the related art has the following problem.

Since the image forming apparatus in the related art adopts the structure in which the developing unit support is moved in the radial direction of the image bearing member to bring each developer bearing member in contact with the surface of the image bearing member or isolate each developer bearing member from the surface of the image bearing member, it is necessary to prepare a space in which the developing unit support is moved.

In addition, it is necessary to provide, for example, a cam serving as a driving unit that moves the developing unit support to the radial direction of the image bearing member in conjunction with the contact and isolation operation.

In other words, it is necessary to provide the space and the driving unit for moving the entire developing unit support to the radial direction of the image bearing member to bring each developer bearing member in contact with or isolate each developer bearing member from the surface of the image bearing member in the rotary image forming apparatus in the related art. Accordingly, it is difficult to achieve a reduction in size and cost of the main body of the apparatus.

In order to resolve the above problem, the rotation of the developing unit support may be directly used to, for example, cause each developer bearing member to be in contact with the surface of the image bearing member or to be isolated from the surface of the image bearing member without using the driving unit, such as the cam.

However, in the image forming apparatus having such a structure, the developer on the developer bearing member can be unnecessarily transferred to the image bearing member when each developer bearing member passes along the image bearing member due to the rotation of the developing unit support to cause an image defect, such as a streaked image or a spot on the rear face of a sheet of paper.

In order to prevent such an image defect, it is necessary to produce an electric field for preventing the developer from being transferred to the image bearing member between the surface of the image bearing member and the surface of each developer bearing member when the developer bearing member passes along the image bearing member.

In the general rotary image forming apparatus, the contact between an electrical contact of the main body of the image forming apparatus and an electrical contact of each developing unit, at which a developing bias is applied, and the isolation of the main body of the image forming apparatus from the electric contact are repeated in conjunction with the rotation of the developing unit support.

The present invention provides an image forming apparatus, such as a rotary image forming apparatus, capable of generating an excellent image without causing the malfunction of the image forming apparatus and the damage of the electrical contacts.

SUMMARY OF THE INVENTION

According to an aspect of the present invention, an image forming apparatus includes a rotatable image bearing member configured to bear an electrostatic latent image; a charge unit configured to charge the image bearing member; a plurality of developing units each including a developer bearing member that bears developer used for developing the electrostatic latent image; a rotatable developing unit support configured to support the plurality of developing units, the developing unit support being rotated to move each of the developing units to a developing position where the developing unit opposes the image bearing member for developing, the developing unit support including support side electrical contacts at which a bias is applied to the developer bearing members provided in the corresponding developing units; a stop position detecting unit configured to detect a stop position of the developing unit support; a main-body side electrical contact configured to apply a bias to each of the support side electrical contacts in a state in which the main-body side electrical contact is in contact with the support side electrical contact, the main-body side electrical contact being provided in the main body of the image forming apparatus; and a control unit configured to control a bias to be applied to the main-body side electrical contact and a bias to be applied to the charge unit. The voltage of the main-body side electrical contact when each developing unit performs the image formation at the developing position is referred to as a first developing voltage, the voltage of a non-image portion of the image bearing member when the developing unit performs the image formation at the developing position is referred to as a first image bearing member voltage, and the image forming apparatus is capable of performing a position detection sequence in which the developing unit support is rotated to move the developing unit support to a normal stop position by the stop position detecting unit. The voltage of the main-body side electrical contact when each developing unit passes along the developing position in the position detection sequence is referred to as a second developing voltage, the voltage of the image bearing member when the developing unit passes along the developing position in the position detection sequence is referred to as a second image bearing member voltage, and the control unit controls the bias to be applied to the main-body side electrical contact and the bias to be applied to the charge unit so that the second developing voltage has the same polarity as that of the first developing voltage and has an absolute value smaller than that of the first developing voltage, the second image bearing member voltage has the same polarity as that of the first image bearing member voltage and has an absolute value smaller than that of the first image bearing member voltage, and the difference between the second developing voltage and the second image bearing member voltage is larger than that between the first developing voltage and the first image bearing member voltage.

According to another aspect of the present invention, an image forming apparatus includes a rotatable image bearing member configured to bear an electrostatic latent image; a charge unit configured to charge the image bearing member; a plurality of developing units each including a developer bearing member that bears developer used for developing the electrostatic latent image; a rotatable developing unit support configured to support the plurality of developing units, the developing unit support being rotated to move each of the developing units to a developing position where the developing unit opposes the image bearing member for developing, the developing unit support including a plurality of support side electrical contacts at which a bias is applied to the developer bearing members provided in the corresponding developing units; a stop position detecting unit configured to detect a stop position of the developing unit support; a main-body side electrical contact configured to apply a bias to each of the support side electrical contacts in a state in which the main-body side electrical contact is in contact with the support side electrical contact, the main-body side electrical contact being provided in the main body of the image forming apparatus, the rotation of the developing unit support allowing the main-body side electrical contact to be in a contact state and in a non-contact state with each of the support side electrical contacts; and a control unit configured to control a bias to be applied to the main-body side electrical contact and a bias to be applied to the charge unit. The image forming apparatus is capable of performing a position detection sequence and an image formation sequence. In the position detection sequence, the developing unit support is rotated to move the developing unit support to a normal stop position by the stop position detecting unit. The plurality of developing units include a first developing unit and a second developing unit arranged downstream of the first developing unit with respect to the rotation direction of the developing unit support and, in the image formation sequence, the developing unit support is rotated in a state where the developing unit support stops at the normal stop position to cause the first developing unit to pass along without performing the image formation in the first developing unit and the image formation is performed in the second developing unit used as the developing position. In the image formation sequence, the voltage of the bias to be applied to the main-body side electrical contact when the first developing unit passes along the developing position has an absolute value that is larger than that of the voltage of the bias to be applied to the main-body side electrical contact before a first support side electrical contact at which power is supplied to the first developing unit becomes in the contact state with the main-body side electrical contact and that of the voltage of the bias to be applied to the main-body side electrical contact before the support side electrical contact becomes in the non-contact state with the main-body side electrical contact after the first developing unit passes along the developing position. The control unit controls the bias to be applied to the main-body side electrical contact and the bias to be applied to the charge unit so that a first difference in voltage is larger than a second difference in voltage, where the first difference in voltage includes the difference between the voltage of the bias to be applied to the main-body side electrical contact when the first developing unit passes along the developing position and the voltage of the bias to be applied to the main-body side electrical contact before the first support side electrical contact at which power is supplied to the first developing unit becomes in the contact state with the main-body side electrical contact and the difference between the voltage of the bias to be applied to the main-body side electrical contact when the first developing unit passes along the developing position and the voltage of the bias to be applied to the main-body side electrical contact before the first support side electrical contact becomes in the non-contact state with the main-body side electrical contact after the first developing unit passes along the developing position in the image formation sequence, where the second difference in voltage includes the difference between the voltage of the bias to be applied to the main-body side electrical contact when the developing unit passes along the developing position and the voltage of the bias to be applied to the main-body side electrical contact before the support side electrical contact at which power is supplied to the developing unit becomes in the contact state with the main-body side electrical contact and the difference between the voltage of the bias to be applied to the main-body side electrical contact when the developing unit passes along the developing position and the voltage of the bias to be applied to the main-body side electrical contact before the support side electrical contact becomes in the non-contact state with the main-body side electrical contact after the developing unit passes along the developing position in the position detection sequence.

Further features of the present invention will become apparent from the following description of exemplary embodiments with reference to the attached drawings.

BRIEF DESCRIPTION OF THE DRAWINGS

FIG. 11 is a block diagram illustrating the correlation relationship among a control unit, a pulse motor controlled by the control unit, and so on.

DESCRIPTION OF THE EMBODIMENTS

Exemplary embodiments of the present invention will herein be described in detail with reference to the attached drawings. However, the size, material, and shape of each component described in the embodiments and the relative arrangement of the components are to be appropriately modified depending on the structure of an apparatus to which the present invention is applied and various conditions and it is to be understood that the scope of the present invention is not limited to these specific examples and embodiments.

First Exemplary Embodiment

An image forming apparatus according to a first exemplary embodiment of the present invention will now be described with reference to FIGS. 1 to 3, FIGS. 4A to 4D, FIGS. 7A to 7D and FIG. 8, and FIGS. 10 and 11.

Figure 1:
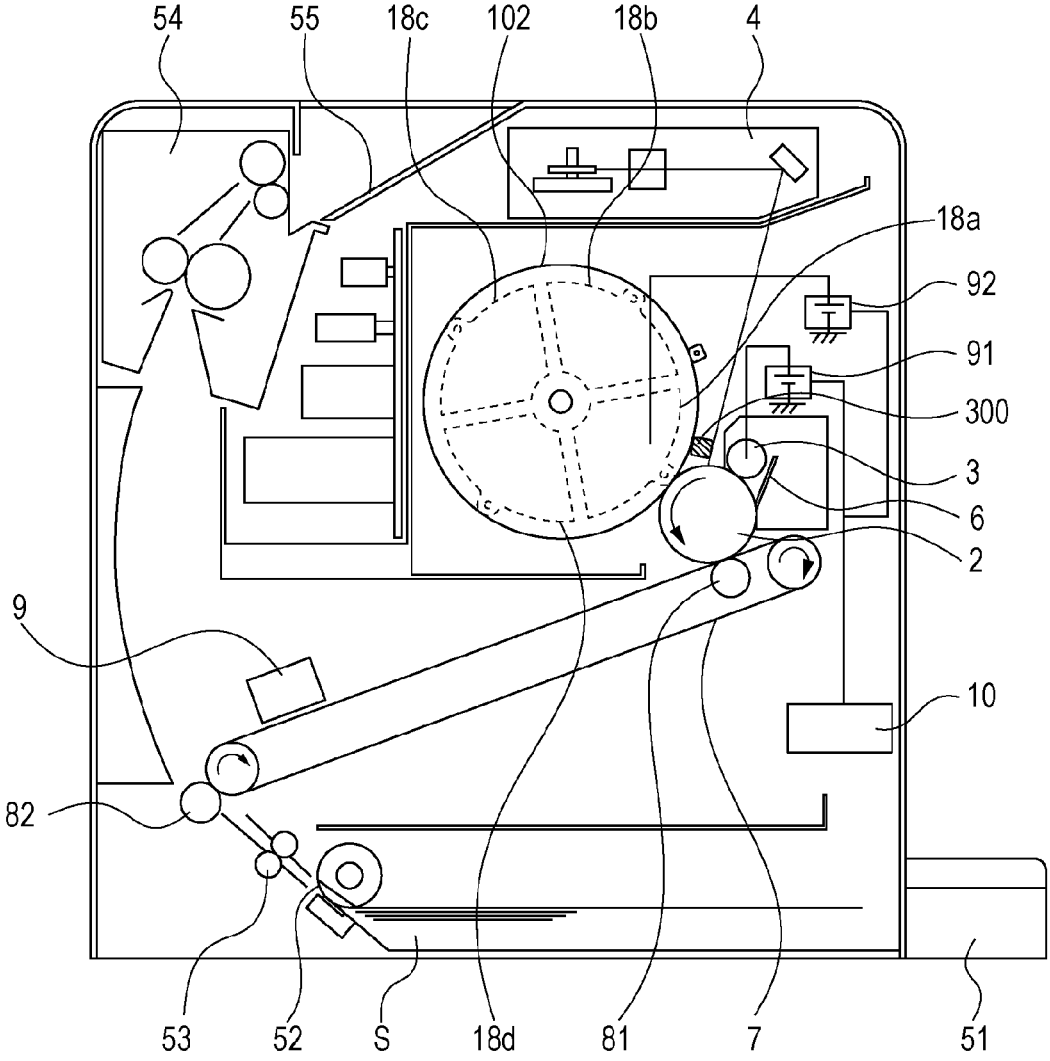
FIG. 1 schematically illustrates an example of the structure of an image forming apparatus according to a first exemplary embodiment.

FIG. 1 schematically illustrates an example of the structure of the image forming apparatus according to the first exemplary embodiment.

An electrophotographic color laser printer using a rotary is used as the image forming apparatus in the first exemplary embodiment.

The color laser printer includes a rotatable photosensitive drum 2 (image bearing member). The color laser printer also includes a charge roller 3, an exposure unit 4, and a cleaning unit 6 around the photosensitive drum 2. The charge roller 3 uniformly charges the surface of the photosensitive drum 2. The exposure unit 4 irradiates the surface of the photosensitive drum 2 with laser light to form an electrostatic latent image. The cleaning unit 6 cleans the surface of the photosensitive drum 2.

Developing units 18*a* to 18*d* are provided for the respective colors (yellow, magenta, cyan, and black) of developer as units for supplying the developer to the electrostatic latent image formed on the surface of the photosensitive drum 2 to develop the electrostatic latent image.

The developing units 18*a* to 18*d* are integrally supported by a substantially circular rotary 102 (developing unit support) capable of rotating in the forward direction with respect to the rotation direction of the photosensitive drum 2. The rotary 102 is configured so as to be rotatable so that each of the developing units 18*a* to 18*d* is positioned at a developing position opposing the photosensitive drum 2. The rotation of the rotary 102 causes the multiple developing units 18*a* to 18*d* to be sequentially moved to the developing position where developer images corresponding to the respective colors are formed.

The developing units 18*a* to 18*d* may be removable from the rotary 102. Such a structure allows supply of the developer and maintenance for every developing unit to improve the convenience of a user. In this case, a door allowing the developing unit 18 to be removable is provided in the main body of the image forming apparatus. The main body of the image forming apparatus also includes a door-close sensor capable of determining the open and close states of the door.

The color laser printer further includes a control unit 10 serving as a controller. The control unit 10 controls a direct-current (DC) high-voltage power source 91 applying a voltage to the charge roller 3, a DC high-voltage power source 92 applying a voltage to the developing units 18*a* to 18*d*, turning on and off of the DC high-voltage power sources 91 and 92, and the magnitude and the variation with time of a bias voltage that is applied. The control unit 10 also controls the rotation operation of the rotary 102.

The color laser printer further includes a photo interpreter 300 that detects a normal stop position (home position) of the rotary 102. A method of detecting the home position of the rotary 102 will be described below.

In the formation of an image on a sheet material S, first, the photosensitive drum 2 is rotated in an arrow direction (counterclockwise) in FIG. 1 in synchronization with the rotation of an intermediate transfer belt 7.

Then, the surface of the photosensitive drum 2 is uniformly charged by the charge roller 3 and is irradiated with, for example, light for a yellow image (exposure) by the exposure unit 4 to form an electrostatic latent image corresponding to the yellow image on the surface of the photosensitive drum 2.

Before the formation of the electrostatic latent image, the rotary 102 is driven by a drive transmission mechanism described below to rotate and move the yellow developing unit 18*a* to a position (developing position) opposing the photosensitive drum 2.

At the developing position, a voltage having the same polarity as the charge polarity of the developer is applied to a rotatable developing roller 182*a* (developer bearing member) of the developing unit 18*a* to adhere the yellow developer to the electrostatic latent image on the photosensitive drum 2 and the electrostatic latent image is developed as the developer image. The charge polarity of the developer is the charge polarity of the developer used in the developing of the electrostatic latent image, and the negatively charged developer is used in the first exemplary embodiment.

Figure 10:
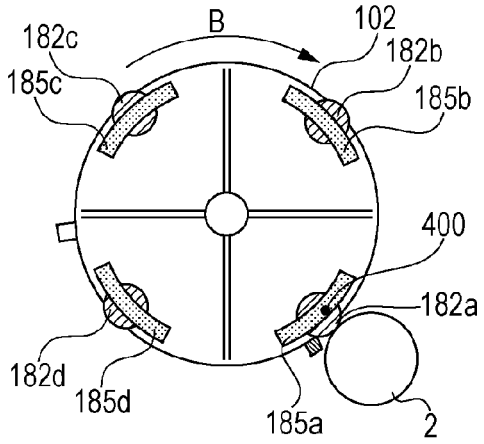
FIG. 10 illustrates the relationship between an electrical contact of the main body of the image forming apparatus, at which power is supplied to the developing units, and the electrical contacts of the developing units.

The color laser printer has a structure in which an electrical contact of the main body of the image forming apparatus at which the power is supplied to the developing unit 18 conducts to an electrical contact of the developing unit 18 during a period from before the developing unit 18 reaches the developing position to after the developing unit 18 passes along the developing position, as illustrated in FIG. 10. A developing bias is capable of being applied during a period before and after the developing position in the above structure.

Referring to FIG. 10, reference numeral 400 denotes a main-body side electrical contact provided on the main body of the apparatus, at which the bias is supplied to the developing roller. The main-body side electrical contact 400 is fixed at a position opposing the developing roller at the developing position. Reference numerals 185*a* to 185*d* denote rotary electrical contacts (support side electrical contacts) provided for the respective developing units in the rotary 102. The rotary electrical contacts 185*a* to 185*d* are in contact with the core metal of the corresponding developing rollers upon mounting of the developing units and the relative positional relationship between the rotary electrical contacts and the core metal of the developing rollers is fixed. The core metal of the developing rollers 182*a* to 182*d* and the electrical contacts 185*a* to 185*d* provided in the rotary 102 are hereinafter collectively referred to as the contacts of the developing unit 18. The main-body side electrical contact 400 is provided so as to be capable of being in contact with the rotary electrical contacts 185*a* to 185*d*. The rotation of the rotary 102 allows the main-body side electrical contact 400 and the rotary electrical contacts 185*a* to 185*d* to be in a contact state or in a non-contact state.

Upon application of a voltage from a power source (not shown) in the image forming apparatus to the main-body side electrical contact 400, the voltage is supplied from the main-body side electrical contact 400 to the rotary electrical contacts 185*a* to 185*d*, which supply the voltage to the developing rollers 182*a* to 182*d*. Accordingly, the voltage of the bias applied to the developing rollers depends on the voltage of the bias applied to the main-body side electrical contact 400. The bias applied to the main-body side electrical contact 400 is hereinafter referred to as the developing bias. The voltage of the main-body side electrical contact 400 is called a developing voltage.

After the developing, the rotary 102 is driven to isolate the developing roller 182*a* from the surface of the photosensitive drum 2. The developer image formed on the surface of the photosensitive drum 2 is primarily transferred to the intermediate transfer belt 7 in response to application of a voltage having a polarity opposite to that of the developer to a primary transfer roller 81 arranged inside the intermediate transfer belt 7 in FIG. 1.

Upon termination of the primary transfer of the yellow developer image in the above manner, the rotary 102 rotates again and the yellow developing unit is sequentially switched to the magenta, cyan, and black developing units (18*b* to 18*d*).

After the developing unit 18 is positioned at the developing position opposing the photosensitive drum 2, the developing and the primary transfer are sequentially performed for magenta, cyan, and black in the same manner as in yellow. As a result, the developer images of the four colors are superposed on the intermediate transfer belt 7 to be transferred to the intermediate transfer belt 7.

A secondary transfer roller 82 is in the non-contact with the intermediate transfer belt 7 during the primary transfer of the developer image of each color to the intermediate transfer belt 7. A cleaning unit 9 that cleans the intermediate transfer belt 7 is also in the non-contact with the intermediate transfer belt 7. The secondary transfer roller 82 and the cleaning unit 9 become in the contact state with the intermediate transfer belt 7 at the timing when the developer images of the four colors are superposed on the intermediate transfer belt 7 to enable secondary transfer on the sheet material S.

The sheet material S is loaded and housed in a feeding cassette 51 provided at a lower position of the main body of the apparatus. The sheet material S is fed from the feeding cassette 51 one by one by a feeding roller 52 and is fed to a registration roller pair 53.

The registration roller pair 53 supplies the sheet material S that is fed to a nip part composed of the intermediate transfer belt 7 and the secondary transfer roller 82. The secondary transfer roller 82 is pressed into contact with the intermediate transfer belt 7 in the nip part (the state illustrated in FIG. 1).

In the secondary transfer to transfer the developer images to the sheet material S, the sheet material S is conveyed to the nip part. Then, application of a voltage having a polarity opposite to the charge polarity of the developer to the secondary transfer roller 82 allows the developer images on the intermediate transfer belt 7 to be collectively secondarily transferred to the surface of the sheet material S.

The sheet material S on which the developer images are secondarily transferred is supplied to a fixing unit 54. The sheet material S is heated and pressurized in the fixing unit 54 to fix the developer images on the sheet material S. Then, the sheet material S is supplied from the fixing unit 54 to an eject unit provided in an upper cover 55 outside the main body of the apparatus.

Figure 2:
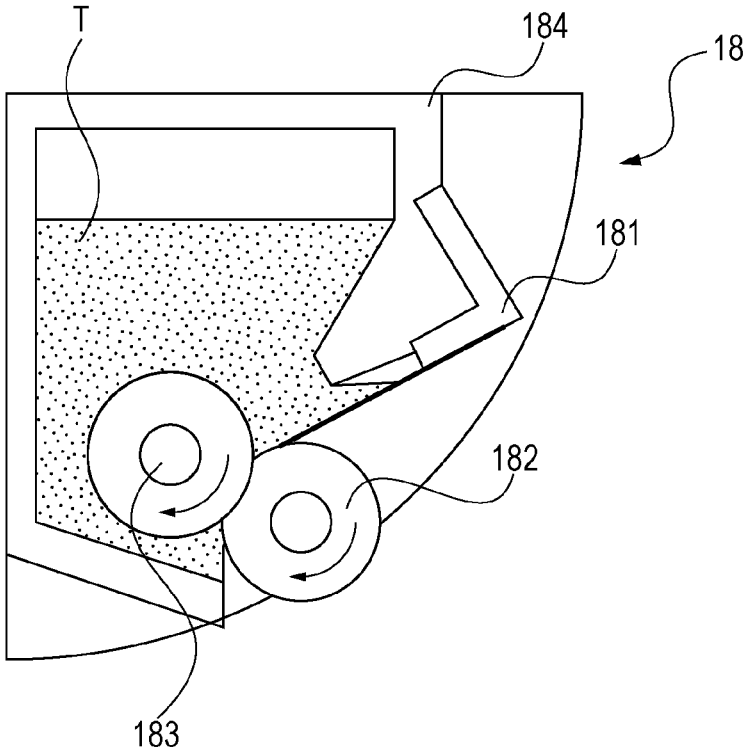
FIG. 2 schematically illustrates an example of the structure of a developing unit in the first exemplary embodiment.

FIG. 2 schematically illustrates an example of the structure of each of the developing units 18*a* to 18*d* in the first exemplary embodiment. Since all the developing units 18*a* to 18*d* in the first exemplary embodiment have the same structure, a description of each of the developing units 18*a* to 18*d* is omitted herein.

The developing unit 18 using a contact developing method is adopted in the first exemplary embodiment. The developing unit 18 adopting the contact developing method includes the developing roller 182 serving as the developer bearing member, a regulation blade 181, a developer supply roller 183, and a developer housing 184. Developer T is housed in the developer housing 184.

The developing roller 182 is capable of rotation. The developing roller 182 is in contact with the surface of the photosensitive drum 2 while the developing roller 182 is rotating with the developer T borne on the surface thereof to supply the developer to an electrostatic latent image formed in advance on the surface of the photosensitive drum 2.

It is assumed in the first exemplary embodiment that the rotation direction of the developing roller 182 is the forward direction with respect to the rotation direction of the photosensitive drum 2 and that the peripheral speed of the developing roller 182 is set to 160% of the peripheral speed of the photosensitive drum 2.

The developing roller 182 is made of silicone rubber which serves as a basic layer, which is adhered to the outer area of the core metal of stainless used steel (SUS), and the surface layer of which is coated with urethane resin in the first exemplary embodiment.

The regulation blade 181 is formed of a thin plate (80 μm in thickness) made of an SUS material. The regulation blade 181 is arranged against the rotation direction of the regulation blade 181. The provision of the regulation blade 181 in the above manner allows the coated amount of the developer on the developing roller 182 to be regulated in conjunction with the rotation of the developing roller 182.

The developer supply roller 183 is formed of an urethane sponge wound around the outer area of the core metal. The developer contained in the developer supply roller 183 is supplied to the surface of the developing roller 182 at a contact portion between the developer supply roller 183 and the developing roller 182.

The developing roller 182 and the developer supply roller 183 rotate in the same direction. In other words, the surfaces of the developing roller 182 and the developer supply roller 183 move in opposite directions at the contact portion between the developing roller 182 and the developer supply roller 183.

The developing unit 18 is structured so that a certain voltage is applied to each member in the developing unit 18 when the developing unit 18 is arranged at the developing position by an operation described below to form an image on the photosensitive drum 2.

In the first exemplary embodiment, for example, the voltage of a non-exposure portion of the photosensitive drum 2 is set to −500 V and the voltage of an exposure portion thereof is set to −150 V in the developing. A voltage of about −350 V is applied to the developing roller 182, the regulation blade 181, and the developer supply roller 183. A reversal developing method in which the developer is adhered to the exposure portion to perform the image formation is adopted in the first exemplary embodiment. Accordingly, the voltage of the non-exposure portion of the photosensitive drum 2 is the voltage of a non-image portion. In a normal developing method, the voltage of the exposure portion of the photosensitive drum 2 is the voltage of the non-image portion.

Setting the voltages in the above manner causes the negative polarity developer not to be adhered to the non-exposure portion and to be adhered to the exposure portion due to an electrostatic force. Although the developing roller 182, the developer supply roller 183, and the regulation blade 181 have the same voltage in the first exemplary embodiment, the voltages that are set are not limited to the above ones and the voltages of the developing roller 182, the developer supply roller 183, and the regulation blade 181 may be differentiated.

Figure 3:
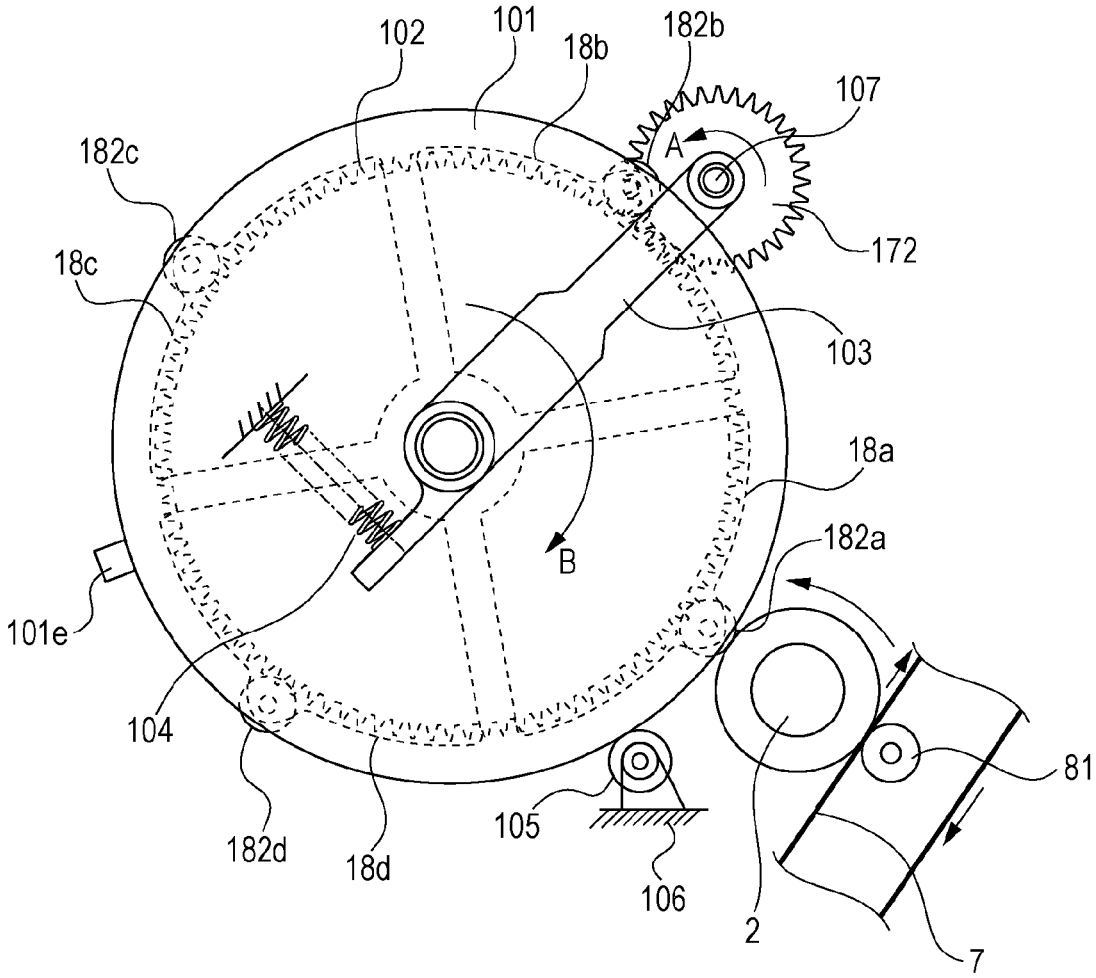
FIG. 3 illustrates an example of the structure of a rotary and peripheral members in the first exemplary embodiment.

FIG. 3 illustrates an example of the structure of the rotary 102 (the developing unit support) and peripheral members in the first exemplary embodiment.

A state (contact state) in which the developing roller 182*a* rotatably supported by the developing unit 18*a* is developing an electrostatic latent image formed on the surface of the photosensitive drum 2 is illustrated in FIG. 3.

Gear teeth are formed along the outer edge of the substantially circular rotary 102 capable of rotation and the gear teeth are mated with a drive gear 172. Specifically, the driving force is transmitted from a drive source (not shown) to the drive gear 172 to rotate the rotary 102. The rotary 102 rotates in a direction B in FIG. 3 when the drive gear 172 rotates in a direction A in FIG. 3 and the rotary 102 stops when the drive gear 172 stops.

The drive gear 172 is supported by the main body of the apparatus via a shaft 107. The drive gear 172 stops when the drive source (not shown) stops and it is not possible for the drive gear 172 to drive the drive source.

The shaft 107 of the drive gear 172 is connected to the center of rotation of the rotary 102 via an arm 103. The arm 103 is pivotably supported by the shaft 107. The arm 103 is urged by an arm spring 104 one end of which is fixed to the main body of the apparatus to receive the pivot force of the center of the shaft 107.

The rotary 102 integrally supports the developing units 18*a* to 18*d* so that the developing rollers 182*a* to 182*d* of the developing units 18*a* to 18*d* are positioned on a substantial circumference (substantial outer edge) of the rotary 102 and the rotary 102 is rotatably supported by the arm 103.

A disk 101 capable of rotating concentrically with the rotary 102 is provided at the front side of the rotary 102 in the drawing. The disk 101 is engaged with the rotary 102 at the center of rotation.

Although the rotary 102 and the disk 101 are separately formed in the first exemplary embodiment, the rotary 102 and the disk 101 may be integrally formed. A protrusion 101*e* is provided on the outer wall of the disk 101 so as not to interfere with other members. The protrusion 101*e* serves as a rotary position detection flag for detecting the home position of the rotary.

A regulation roller 105 is provided near the disk 101 so as to be in contact with the outer edge of the disk 101. The regulation roller 105 is rotatably supported by a roller holder 106 provided in the main body of the apparatus while being in contact with the outer edge of the disk 101.

Since the surface layer of the regulation roller 105 is made of elastic rubber, it is possible to reduce the noise occurring when the regulation roller 105 is in contact with the outer edge of the disk 101. In addition, it is possible to reliably rotate the disk 101 because of a high friction coefficient of the rubber layer.

Although the regulation roller 105 is rotatably supported by the roller holder 106 in the first exemplary embodiment, it is not necessary for the regulation roller 105 to be rotatable and, further, to be a roller if the outer face of the regulation roller 105 has high sliding performance. In other words, the regulation roller 105 may be any member that reliably guides the rotation of the disk 101 while being in contact with the outer edge of the disk 101 and does not prevent the rotation of the disk 101.

The arm 103 urged by the arm spring 104 urges the rotary 102 to apply a contact pressure between the developing roller 182*a* and the photosensitive drum 2. The disk 101 and the regulation roller 105 are formed so that a desirable contact pressure is applied between the developing roller 182*a* and the photosensitive drum 2.

As described above, the developing rollers 182*a* to 182*d* can be sequentially in contact with and isolated from the surface of the photosensitive drum 2 only by rotating the rotary 102 in the first exemplary embodiment.

In other words, the operation to make the developing rollers 182*a* to 182*d* contact with the surface of the photosensitive drum 2 and the operation to isolate the developing rollers 182*a* to 182*d* from the surface of the photosensitive drum 2 are performed from the tangential direction of the photosensitive drum 2 in the first exemplary embodiment.

Accordingly, since, for example, the structure in which the entire rotary 102 is moved to the radial direction of the photosensitive drum 2 is not required, it is not necessary to prepare a space in which the developing rollers 182*a* to 182*d* are in contact with and isolated from the surface of the photosensitive drum 2. As a result, the reduction in size of the main body of the apparatus can be achieved.

In addition, since the contact and isolation operations of the developing rollers 182*a* to 182*d* can be performed by rotating the rotary 102 to switch the developing units 18*a* to 18*d*, it is not necessary to provide a special structure and a special drive source for the contact and isolation operations. Accordingly, the reduction in manufacturing cost can be achieved.

Furthermore, since the contact and isolation operations can be performed simultaneously with the switching of the developing units 18*a* to 18*d*, it is possible to sequentially make the developing rollers 182*a* to 182*d* contact with the photosensitive drum 2 and isolate the developing rollers 182*a* to 182*d* from the photosensitive drum 2 at a high speed.

Furthermore, a pulse motor is used as the drive source (not shown) for the rotary 102 so as to freely control the rotation and drive of the rotary 102 in the first exemplary embodiment. The rotary 102 rotates by one degree per one pulse of the pulse motor.

A method of detecting the home position of the rotary in the image forming apparatus in the first exemplary embodiment will now be described. FIGS. 4A to 4D schematically illustrate the photosensitive drum 2 and the rotary 102 of the first exemplary embodiment.

The rotary 102 rotates in the direction B in FIGS. 4A to 4D. Reference numeral 102*a* denotes the portion where the yellow developing unit is mounted, reference numeral 102*b* denotes the portion where the magenta developing unit is mounted, reference numeral 102*c* denotes the portion where the cyan developing unit is mounted, and reference numeral 102*d* denotes the portion where the black developing unit is mounted.

Reference numeral 300 denotes the photo interpreter provided in the main body of the apparatus separately from the rotary 102. The photo interpreter 300 includes a light emitting part, which is a light emitting diode, and a photo detector, which is a photo transistor. The photo interpreter 300 is provided to detect the passing of the protrusion 101*e* serving as the position detection flag, which provided on the circumference of the rotary disk 101. The photo interpreter 300 and the protrusion 101*e* compose a normal-stop-position detecting unit.

The protrusion 101*e* is provided toward the upstream in the rotation direction in the portion 102*d* where the black developing unit is mounted in the first exemplary embodiment.

Figure 4A:
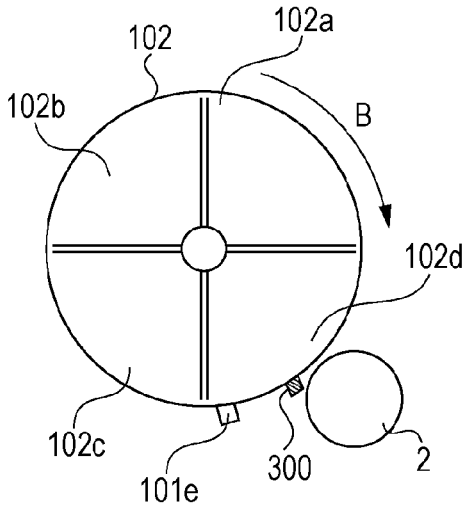
FIGS. 4A to 4D schematically illustrate how to detect a home position of the rotary in the first exemplary embodiment.

FIG. 4A indicates the position of the rotary during the developing of black. The portion 102*d* where the black developing unit is mounted opposes the photosensitive drum 2 in FIG. 4A.

Figure 4B:
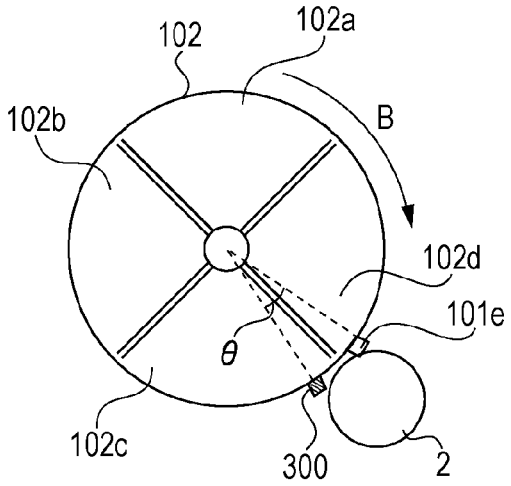

FIG. 4B indicates the normal stop position (home position) of the rotary 102. The home position results from the counterclockwise rotation of the rotary 102 by 45° from the state in FIG. 4A. The photosensitive drum 2 is in contact with no developing unit.

The rotary 102 normally stops at the home position when the image formation is terminated, when a variety of calibration is terminated, or in a case in which the rotary 102 is prepared for the subsequent image formation.

The control unit 10 of the main body of the apparatus controls all the operations of the rotary 102 with respect to the home position.

The photo interpreter 300 is arranged so as to detect the protrusion 101*e* when the rotary 102 moves clockwise from the home position by an angle θ°. The angle θ° is equal to 20° in the image forming apparatus of the first exemplary embodiment.

Figure 4C:
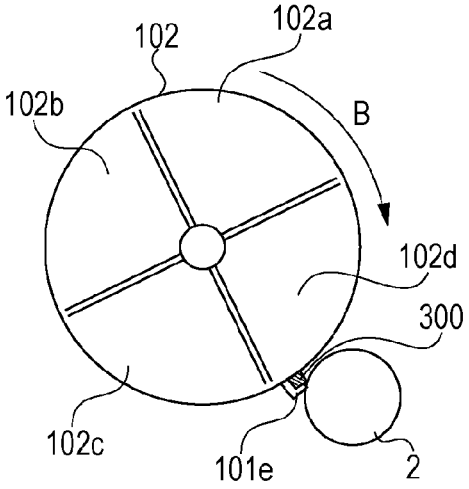

FIG. 4C indicates a state in which the rotary 102 rotates by θ° from the home position. At this time, the protrusion 101*e* on the rotary disk 101 intercepts the light emitting part and the photo detector of the photo interpreter 300 and the control unit 10 recognizes the rotary position detection flag.

Figure 4D:
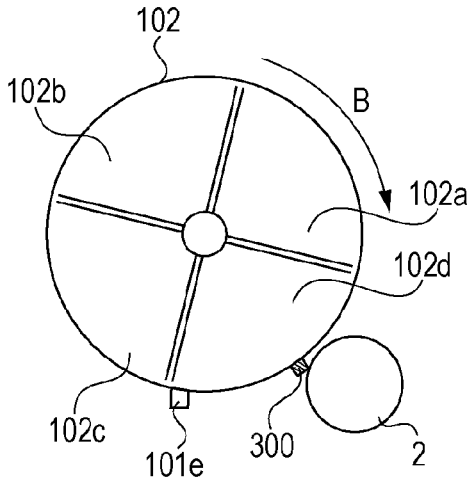

FIG. 4D indicates an exemplary state in which the rotary 102 stops at a position other than the home position.

Since the control unit 10 cannot recognize the position of the rotary 102 in this state, it is not possible to correctly synchronize the rotation of the rotary 102 with other operations, such as the application of various biases and the drive of the photosensitive drum 2.

Accordingly, it is necessary to return the rotary 102 to the home position if the rotary 102 possibly stops at a position other than the home position.

In the first exemplary embodiment, a position detection sequence can be performed, in which the rotary 102 is rotated from a state in which the stop position of the rotary 102 is unknown and the rotary 102 is determined to be moved to the home position by the normal-stop-position detecting unit, such as the photo interpreter. Specifically, the rotary 102 is rotated in the direction B until the photo interpreter 300 detects the protrusion 101*e* serving as the rotary position detection flag.

After the detection of the protrusion 101*e*, the control unit 10 further rotates the rotary 102 by (360-θ)° and stops the rotary 102 to move the rotary 102 to the home position.

Accordingly, the amount of rotation of the rotary 102 is varied depending on the positional relationship between the protrusion 101*e* and the photo interpreter 300 if the rotary 102 possibly stops at a position other than the home position. Specifically, the control unit 10 rotates the rotary 102 by an angle within a range from (360-θ)° to (720-θ)° until the rotary 102 moves to the home position.

The timing when the detection of the home position (the position detection sequence) is performed will now be described.

Figure 11:
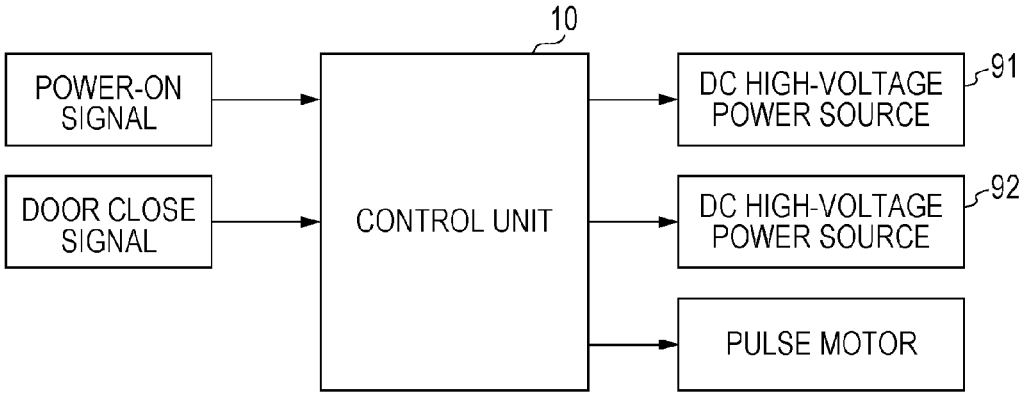

FIG. 11 is a block diagram illustrating the correlation relationship among the control unit 10, the DC high-voltage power source 91 applying a voltage to the charge roller 3, the DC high-voltage power source 92 applying a voltage to the developing units, and the pulse motor controlling the drive of the rotary 102. The DC high-voltage power source 91, the DC high-voltage power source 92, and the pulse motor are controlled by the control unit 10.

Upon detection of a power-on signal or a door close signal for the main body of the apparatus, the control unit 10 performs the detection of the home position of the rotary. In the detection of the home position of the rotary, the control unit 10 controls the DC high-voltage power source 91 and the DC high-voltage power source 92 to control a charge bias to be applied to the charge roller 3, a developing bias to be applied to the developing roller 182, and the pulse motor.

First, the detection of the home position after the apparatus is turned on will be described in detail.

The power supply to the main body of the apparatus is stopped, for example, when the user intentionally turns off the main body of the apparatus or pulls out the power cord while the main body of the apparatus stops. In such a case, the rotary 102 should basically be at the home position when the apparatus is turned on next time.

However, if an irregular event occurs, for example, if the user erroneously rotates the rotary 102 while the apparatus is turned off, the control unit 10 cannot determine that the rotary 102 is not at the home position when the apparatus is turned on next time.

In addition, the power supply to the main body of the apparatus may be suddenly stopped when the power cable of the main body of the apparatus is pulled out or a power failure occurs during the image formation. Also in such a case, the control unit 10 cannot determine that, for example, the rotary 102 is not at the home position when the apparatus is turned on next time.

Since the rotary 102 is not necessarily be at the home position after the apparatus is turned on, as described above, the control unit 10 unfailingly performs the detection of the home position once.

Furthermore, when the developing units are removable from the main body of the image forming apparatus, the user may erroneously rotate the rotary 102 while the door of the main body of the apparatus is opened for the installation or removal of the developing units, as in the case in which the apparatus is turned off.

Accordingly, the control unit 10 performs the detection of the home position of the rotary 102 once also when the door is changed from the open state to the close state.

Next, the detection of the home position after the main body of the apparatus is subjected to emergency stop due to paper jam will be described.

If the time when the medium S stays in the apparatus, detected by a medium passing sensor (not shown) provided on the path of the medium S from the feeding cassette 51 to the fixing unit 54, is longer than a predetermined value, the control unit 10 determines that the paper jam occurs and performs the emergency stop of the main body of the apparatus.

At this time, the rotary 102 may stop at a position other than the home position.

Upon detection of turning on of the main body of the apparatus or closing of the door of the main body of the apparatus after the medium jammed in the apparatus is removed, the control unit 10 performs a resetting operation to remove the developer adhered to the photosensitive drum 2 and/or the intermediate transfer belt 7 in order for the main body of the apparatus to prepare the next image formation. In this resetting operation, the control unit 10 also performs the detection of the home position of the rotary 102.

Various biases that are applied when the rotary 102 rotates and the developing roller 182 passes along the photosensitive drum 2 in the detection of the home position of the rotary 102 will now be described.

A case in which the rotary 102 may possibly stop at a position other than the home position will now be described with reference to FIGS. 7A to 7D and FIG. 8.

FIGS. 7A to 7D schematically illustrate the positions of the rotary 102 and the photosensitive drum 2. FIG. 8 is a timing chart indicating the rotation state of the rotary, the developing contact state, the application state of the developing bias, and the application state of the charge bias. Steps (s1) to (s17) in the following description correspond to (s1) to (s17) in FIG. 8.

Figure 7A:
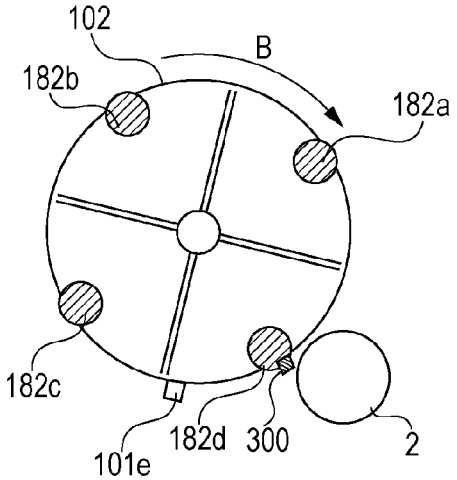
FIGS. 7A to 7D schematically illustrate the positions of the rotary before the home position is detected in the first embodiment of the present invention.
Figure 7B:
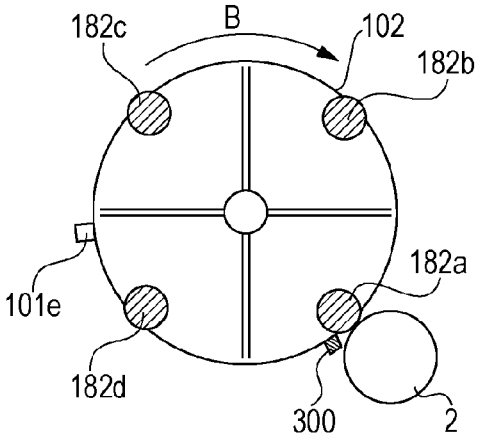
Figure 8:
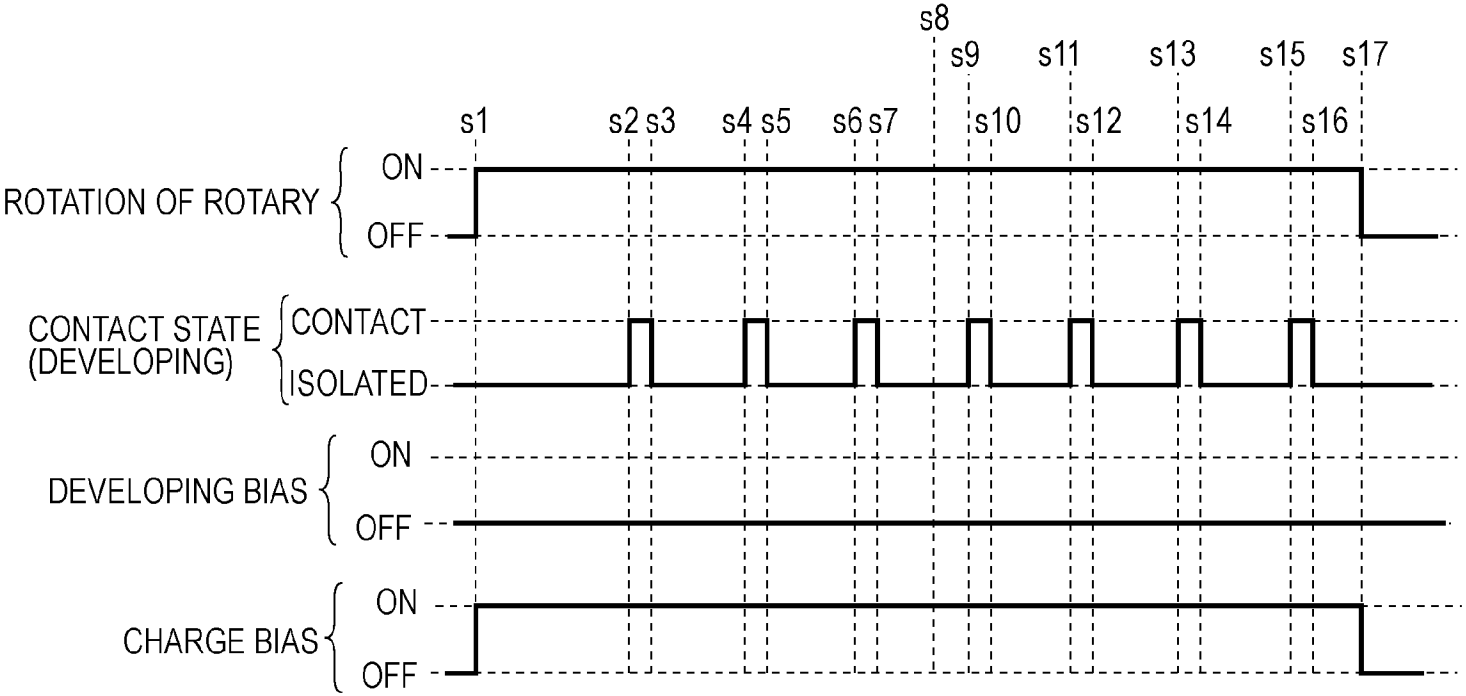
FIG. 8 is a timing chart before the home position is detected in the first embodiment of the present invention.

FIG. 7A illustrates an exemplary state in which the rotary 102 stops at a position other than the home position. The rotary 102 stops at a position resulting from rotation of the rotary 102 from the home position in the direction B by about 60°.

After the main body of the apparatus is turned on, the control unit 10 starts the detection of the home position of the rotary 102. The control unit 10 rotates the rotary 102 until the photo interpreter 300 detects the rotary position detection flag (the protrusion 101*e*) (s1) and, then, rotates the rotary 102 by (360-θ)° to return the rotary 102 to the home position.

The developing rollers 182*a* to 182*d* of the respective colors pass along the contact position with the photosensitive drum 2 a total of seven times since the rotary 102 has started the rotation (s1) during a period from the state in FIG. 7A to the termination of the detection of the home position.

Specifically, the yellow developing roller 182*a* passes along the photosensitive drum 2 in (s2) to (s3) (FIG. 7B), the magenta developing roller 182*b* passes along the photosensitive drum 2 in (s4) to (s5), and the cyan developing roller 182*c* passes along the photosensitive drum 2 in (s6) to (s7).

Figure 7C:
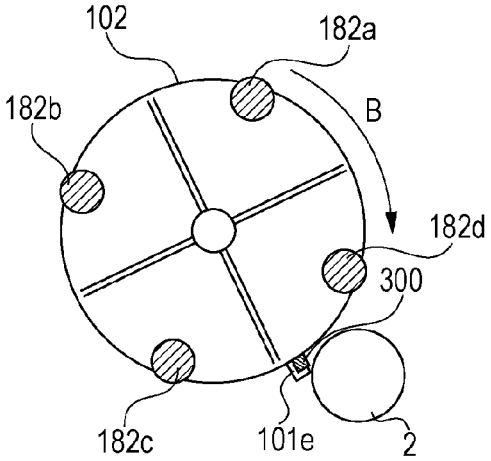

Then, as illustrated in FIG. 7C, the photo interpreter 300 detects the rotary position detection flag (the protrusion 101*e*) (s8).

Figure 7D:
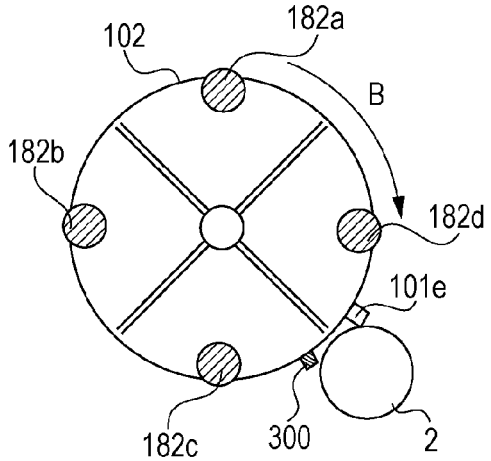

Then, the rotary 102 further rotates by (360-θ)°. The black developing roller 182*d* passes along the contact position with the photosensitive drum 2 in (s9) to (s10). The yellow developing roller 182*a* passes along the contact position with the photosensitive drum 2 in (s11) to (s12). The magenta developing roller 182*b* passes along the contact position with the photosensitive drum 2 in (s13) to (s14). The cyan developing roller 182*c* passes along the contact position with the photosensitive drum 2 in (s15) to (s16). The rotary 102 stops at the home position (s17), as illustrated in FIG. 7D.

Also during the detection of the home position, it is necessary to produce an electric field for preventing the developer on the developing roller 182 from being transferred to the photosensitive drum 2 between the developing roller 182 and the photosensitive drum 2 when the developing roller 182 passes along the photosensitive drum 2.

However, since the control unit 10 cannot recognize the position of the rotary during the detection of the home position, it is not possible to apply the developing bias in synchronization with the timing when the developing roller 182 passes along the photosensitive drum 2.

In addition, when the charge bias and the developing bias (a first developing voltage) similar to the ones during the image formation are continuously applied during the detection of the home position, the control unit 10 erroneously detected electrical noise occurring when the electrical contact of the main body of the apparatus is in contact with or is isolated from the electrical contact of the developing unit 18. At this time, the voltage of the non-exposure portion on the surface of the photosensitive drum 2 is equal to the voltage during the image formation (a first image bearing member voltage).

The erroneous detection of the electrical noise by the control unit 10 may cause a problem, such as stop of the main body of the apparatus.

Even if the above problem does not occur, repeating the print operation may cause spark discharge caused by the contact and isolation of the electrical contacts in the energized state to be repeated to damage the electrical contact of the main body of the apparatus or the developing unit 18.

In order to resolve the above problems, the developing bias (a second developing voltage) is not applied to the developing roller 182 during the detection of the home position of the rotary and a charge bias of −650 V causing the voltage of the non-exposure portion on the surface of the photosensitive drum 2 to be −150 V (a second image bearing member voltage) was applied to the charge roller 3.

At this time, the difference between the voltage of the non-exposure portion on the surface of the photosensitive drum 2 and the developing bias applied to the developing roller 182 is equal to −150 V, as in the image formation.

Controlling the voltages in the above manner allows the electric field for preventing the developer on the developing roller 182 from being transferred to the photosensitive drum 2 to be constantly produced between the surface of the photosensitive drum 2 and the developing roller 182 without applying the developing bias during the detection of the home position.

Since the developing bias is not applied, it is not necessary to consider the problems caused when the electrical contact of the main body of the apparatus is contact with or is isolated from the electrical contact of the developing unit in the energized state.

Although the image forming apparatus is structured so that the developing bias is not applied during the detection of the home position in the first exemplary embodiment, the electrical noise and the level of the spark discharge can be reduced by setting the developing bias to a value that has the same polarity as that in the image formation and that has an absolute value smaller than that in the image formation even if the developing bias is not set to zero.

In other words, it is possible to reduce the incidence of the malfunction of the image forming apparatus due to the electrical noise and to suppress the damage of the electrical contacts due to the spark discharge.

The difference between the surface potential of the photosensitive drum 2 and the surface potential of the developing roller 182 when the developing roller 182 passes along the photosensitive drum 2 is set to −150 V, as in the image formation, in the first exemplary embodiment. However, it is possible to more effectively prevent the developer on the developing roller 182 from being transferred to the photosensitive drum 2 by controlling the charge bias and the developing bias so as to make the value of the above difference larger than that in the image formation. At the least, it is important that the difference between the surface potential of the photosensitive drum 2 and the surface potential of the developing roller 182 when the developing roller 182 passes along the photosensitive drum 2 in the detection of the home position is made larger than the difference in potential in the image formation.

As described above, according to the first exemplary embodiment, it is possible to prevent the developer from being unnecessarily adhered to the image bearing member also during the detection of the home position of the rotary without considering the problems caused when the electrical contact of the main body of the apparatus is contact with or is isolated from the electrical contact of the developing unit in the energized state.

Second Exemplary Embodiment

The method of applying the developing bias to be applied to the developing roller and the charge bias when the developing unit passes along the developing position in the detection of the home position is described in the first exemplary embodiment.

In contrast, according to a second exemplary embodiment of the present invention, a case in which the rotary 102 is rotated in the state where the rotary 102 stops at the home position to cause a first developing unit to pass along the developing position without performing the image formation in the first developing unit and the image formation is performed in a second developing unit, which is used as the developing position, will be described. Such a sequence is called an image formation sequence.

The second developing unit is arranged downstream of the first developing unit in the rotation direction of the rotary 102.

The rotation of the rotary is controlled in the above manner in response to a color image formation signal transmitted when the rotary 102 is at the home position.

In terms of the home position of the rotary 102 in the image forming apparatus according to the second exemplary embodiment, the black developing unit 18*d* is arranged immediately before the developing position so that the image formation operation can be started as soon as a monochrome image formation signal is transmitted.

The image formation is sequentially performed in the order of yellow, magenta, cyan, and black when a full-color image formation signal is transmitted in the image forming apparatus in the second exemplary embodiment. Accordingly, the black developing unit 18*d* (the second developing unit) passes along the developing position without performing the image formation when the yellow developing unit 18*a* (the first developing unit) is caused to move to the developing position.

Also in this case, as in the first exemplary embodiment, it is necessary to produce the electric field for preventing the transfer of the developer between the developing roller 182*d* and the photosensitive drum 2 in order to prevent the developer on the black developing roller 182*d* from being transferred to the photosensitive drum 2 at the developing position.

However, when the rotary 102 is at the home position, as in the second exemplary embodiment, the control unit 10 can apply the developing bias in synchronization with the timing when the developing roller 182*d* passes along the photosensitive drum 2.

Specifically, the application of the developing bias is started before the developing roller 182*d* passes along the photosensitive drum 2 since the electrical contact of the image forming apparatus has been in contact with the electrical contact of the developing unit 18*d*. The application of the developing bias is terminated before the electrical contact of the image forming apparatus is isolated from the electrical contact of the developing unit 18*d* since the developing roller 182 has passed along the photosensitive drum 2. The application of the developing bias can be started and terminated in the above manner to resolve the problems described above.

As described above, when the rotary 102 stops at the home position, it is possible to prevent the developer on the developing roller 182*d* from being transferred to the photosensitive drum 2 while avoiding the contact and isolation of the electrical contacts in the energized state.

A case in which the developing roller 182 passes along the photosensitive drum 2 from the state where the rotary 102 stops at the home position will now be described with reference to FIGS. 5A to 5C and FIG. 6. An operation in which the yellow developing roller 182*a* moves from the home position to the developing position is exemplified here.

Figure 5A:
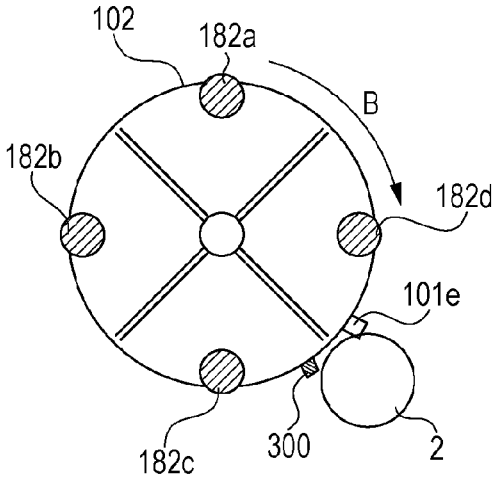
FIGS. 5A to 5C schematically illustrate the positions of the rotary after the rotary stops at the home position in a second embodiment of the present invention.
Figure 5B:
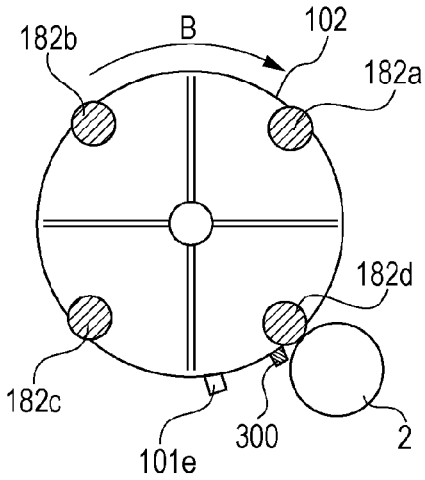
Figure 5C:
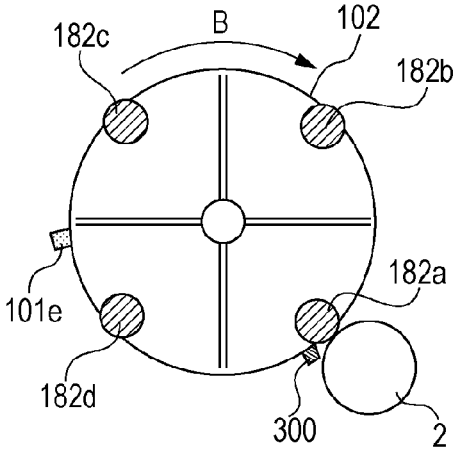
Figure 6:
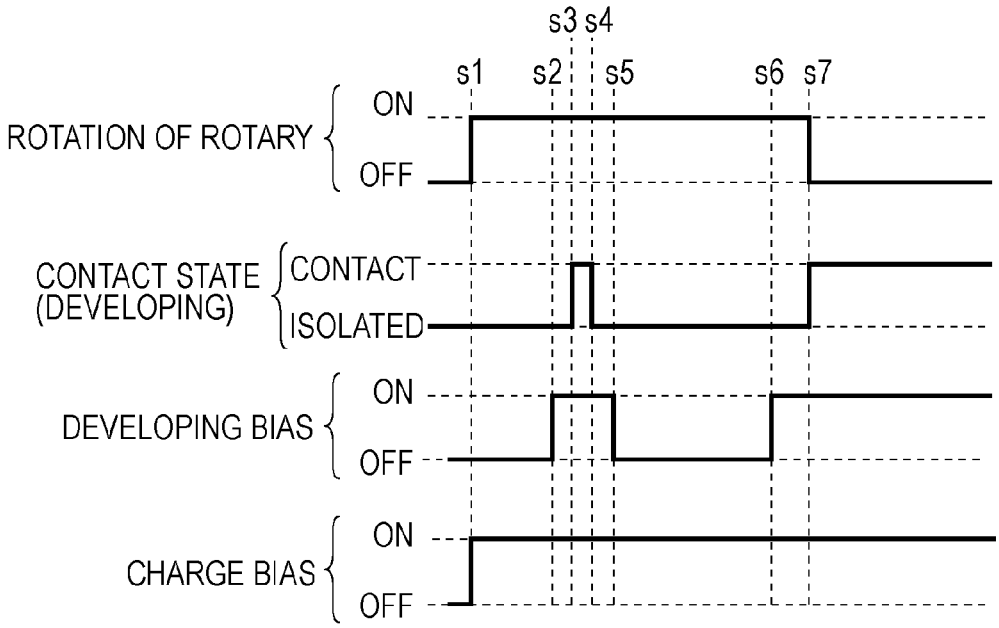
FIG. 6 is a timing chart after the rotary stops at the home position in the second embodiment of the present invention.

FIGS. 5A to 5C schematically illustrate the positions of the rotary 102 and the photosensitive drum 2. FIG. 6 is a timing chart indicating the rotation state of the rotary, the developing contact state, the application state of the developing bias, and the application state of the charge bias. Steps (s1) to (s7) in the following description correspond to (s1) to (s7) in FIG. 6.

FIG. 5A illustrates the state in which the rotary 102 is at the home position. At the home position, the yellow developing roller 182*a* is positioned at an upper part of the rotary 102 in the drawing.

In response to a printing instruction from a controller (not shown), the control unit 10 applies a charge bias of −1,000 V for the image formation to the charge roller 3 to set the surface potential of the photosensitive drum 2 to −500 V (a third image bearing member voltage). The control unit 10 starts to rotate the rotary 102 in the direction B (s1) in order to move the developing roller 182*a* of yellow, which is the first color to be printed, to the developing position.

After the electrical contact of the main body of the apparatus is in contact with the electrical contact of the black developing unit 18*d*, the control unit 10 applies a developing bias of −250 V (a third developing voltage) (s2) in preparation for the black developing roller 182*d* that passes along the photosensitive drum 2 (s3).

At this time, the difference between the voltage of the non-exposure portion on the surface of the photosensitive drum 2 and the voltage of the developing bias to be applied to the developing roller 182 is equal to 250 V that is 100 V larger than that in the image formation.

FIG. 5B illustrates the home position of the rotary while the black developing roller 182*d* is passing along the photosensitive drum 2. A state in which the rotary rotates from the home position by 45° in the direction B is illustrated in FIG. 5B.

At this time, the negative polarity developer on the developing unit 18*d* is prevented from being transferred to the photosensitive drum 2 due to the electric field formed by the photosensitive drum 2 charged with −500 V and the developing roller 182*d* to which the developing bias of −250 V is applied.

After the black developing roller 182*d* has passed along the photosensitive drum 2 (s4), the control unit 10 turns off the developing bias (s5) before the electrical contact of the main body of the apparatus is isolated from the electrical contact of the black developing unit 18*d*.

Before the yellow developing unit 18*a* is in contact with the photosensitive drum 2 (s7) since the electrical contact of the main body of the apparatus has been in contact with the electrical contact of the yellow developing unit 18*a*, the control unit 10 applies a developing bias of −350V during the image formation (s6) to prepare the developing contact of the yellow developing roller 182*a*.

In synchronization with the developing contact of the yellow developing roller 182*a*, the control unit 10 stops the drive of the rotary to start to form a yellow image (s7). The position of the rotary at this time is illustrated in FIG. 5C.

As described above, when the rotary 102 stops at the home position, the control unit 10 controls the timing when the developing bias is applied in order to prevent the developer on the developing roller 182 to be unnecessarily transferred to the photosensitive drum 2 when the developing roller 182 passes along the photosensitive drum 2.

The second exemplary embodiment is characterized in that the developing bias voltage (the third developing voltage) when the developing roller 182 passes along the photosensitive drum 2 from the state in which the developing roller 182 stops at the home position is different from the developing bias voltage (the second developing voltage) in the position detection sequence.

In addition, the surface potential (the third image bearing member voltage) of the photosensitive drum 2 when the developing roller 182 passes along the photosensitive drum 2 from the state in which the developing roller 182 stops at the home position is different from the surface potential (the second image bearing member voltage) of the photosensitive drum 2 in the position detection sequence in the second exemplary embodiment.

Specifically, the third developing voltage is set to a value that has the same polarity as that of the second developing voltage and that has an absolute value larger that of the second developing voltage. The third image bearing member voltage is set to a value that has the same polarity as that of the second image bearing member voltage and that has an absolute value larger than that of the second image bearing member voltage.

Figure 9:
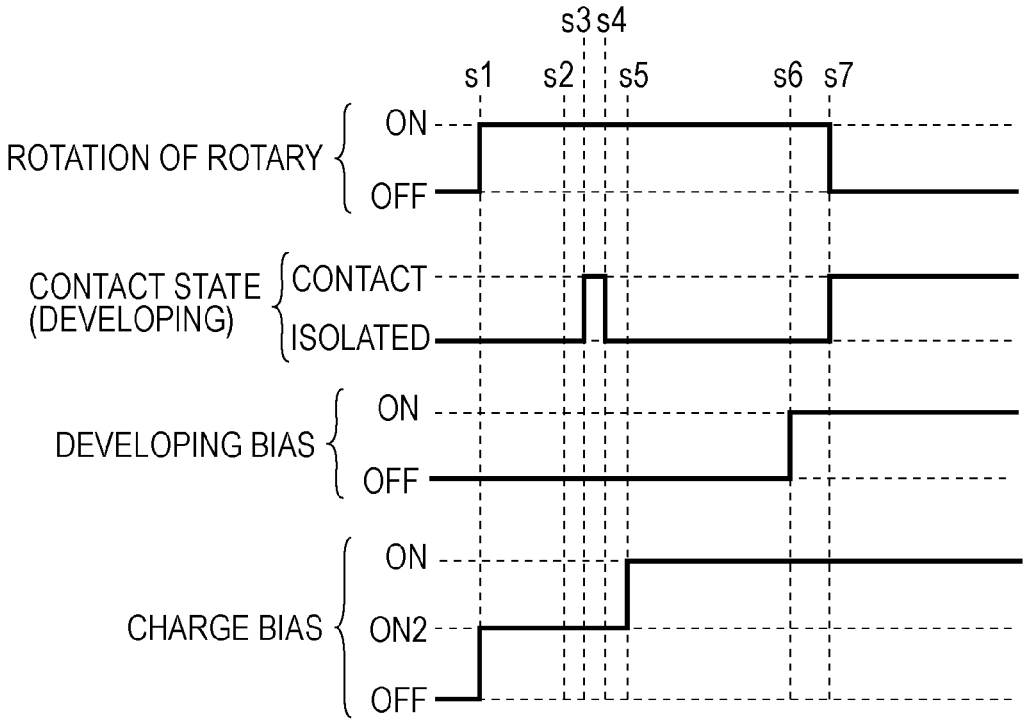
FIG. 9 is a timing chart when a bias is controlled in the same manner as in a position detection sequence in the second embodiment of the present invention.

The reason why the third developing voltage and the third image bearing member voltage are set to the above values will now be described with reference to a timing chart in FIG. 9. A case in which control processing similar to the position detection sequence in the first exemplary embodiment is performed from the state where the rotary 102 stops at the home position is exemplified here. Steps (s1) to (s7) in the following description correspond to (s1) to (s7) in FIG. 9.

In response to a printing instruction from the controller (not shown), the control unit 10 applies a charge bias of −650 V that has the same polarity as in the image formation and that has an absolute value smaller than that in the image formation to the charge roller 3 to charge the surface potential of the photosensitive drum 2 with a voltage of −150 V (the second image bearing member voltage). The control unit 10 starts to rotate the rotary 102 in the direction B (s1) in order to move the developing roller 182*a* of yellow, which is the first color to be printed, to the developing position.

Then, the control unit 10 does not apply the developing bias (the second developing voltage) and the black developing roller 182*d* passes along the photosensitive drum 2 (s2 to s5). The control unit 10 switches the charge bias to a charge bias of −1,000 V for the image formation (s5) and charges the image bearing member with a voltage of −500 V (the first image bearing member voltage). The control unit 10 applies the developing bias (the first developing voltage) for the image formation (s6) after the electrical contact of the main body of the apparatus is in contact with the electrical contact of the developing unit 18*a* before the yellow developing unit 18*a* moves to the developing position (s7). Then, the yellow developing unit 18*a* is in contact with the photosensitive drum 2 to start the image formation.

The surface potential of the photosensitive drum 2 is changed stepwise from −150 V to −500 V in conjunction with the switching of the charge bias in (s5). This stepped charge variation does not completely disappear in the subsequent one charge and a stepped density variation may occur in the yellow image.

As described above, when the rotary 102 stops at the home position, setting the developing bias (the second developing voltage) and the second image bearing member voltage in the manner as in the position detection sequence causes an image defect, such as the density variation. This is because it is necessary to set the second developing voltage to a value that has a smaller absolute value in the position detection sequence in order to avoid the damage of the electrical contact of the developing unit 18. In order to prevent fogging from the developing unit, it is not desirable that the difference between the voltage of the photosensitive drum (the second image bearing member voltage) and the developing bias voltage (the second developing voltage) be too large or too small. Accordingly, setting the second developing voltage to a smaller value causes the second image bearing member voltage to be a smaller value in accordance with the value of the second developing voltage. As described above, setting the second image bearing member voltage to a smaller value causes an image defect caused by the charge variation described above.

When the rotary 102 stops at the home position, it is not necessary to set the developing bias voltage to an excessively small value, unlike the position detection sequence, because the developing bias can be appropriately turned on and off. Accordingly, when the rotary 102 stops at the home position, the developing bias voltage (the third developing voltage) is set to a value that has the same polarity as that of the second developing voltage and that has an absolute value larger than that of the second developing voltage in synchronization with the timing when the black developing roller 182*d* passes along the developing position. The voltage of the photosensitive drum (the third image bearing member voltage) is set to a value that has the same polarity as that of the second image bearing member voltage and that has an absolute value larger than that of the second image bearing member voltage.

The electric field for preventing the transfer of the developer is provided between the developing roller 182*d* and the photosensitive drum 2 to prevent the image defect caused by the voltage variation by setting the voltages in the above manner.

In addition, making the difference in voltage between the developing roller 182 and the non-exposure portion on the surface of the photosensitive drum 2 larger than that in the image formation allows the transfer of the developer from the developing roller 182 to the photosensitive drum 2 to be more effectively prevented.

The position detection sequence will now be compared with the image formation sequence.

In the image formation sequence, the developing voltage is switched in synchronization with the timing when the black developing roller 182*d* passes along the developing position. The developing voltage when the developing roller 182*d* passes along the developing position in the image formation sequence is referred to as the third developing voltage for description. The developing voltage before the rotary electrical contact 185 for supplying power to the developing roller 182*d* is in the contact state with the main-body side electrical contact 400 is referred to as a fourth developing voltage. The third developing voltage differs from the fourth developing voltage (refer to s2 and s3 in FIG. 6). The developing voltage before the rotary electrical contact 185*d* for supplying power to the developing roller 182*d* is in the non-contact state with the main-body side electrical contact 400 after the developing roller 182*d* passes along the developing position is referred to as a fifth developing voltage. The third developing voltage differs from the fifth developing voltage (refer to s4 and s5 in FIG. 6).

The third developing voltage is set to a value that has an absolute value larger than those of the fourth developing voltage and the fifth developing voltage. Setting the voltages in the above manner allows the electric field for preventing the transfer of the developer on the developing roller 182 to the photosensitive drum 2 to be formed when the developing roller 182*d* passes along the developing position. Setting the developing voltage to a smaller value at the timing when the main-body side electrical contact 400 is in contact with (or is isolated from) the rotary electrical contact 185*d* can suppress the contact or isolation of the electrical contacts in the energized state. The difference between the third developing voltage and the fourth developing voltage and the difference between the third developing voltage and the fifth developing voltage are referred to as a first difference in voltage.

In contrast, in the position detection sequence, the developing unit passes along the developing position in a state in which the position of the rotary 102 is unknown. Accordingly, the developing voltage is constantly set to zero in the position detection sequence both at the timing when the main-body side electrical contact 400 is in contact with the rotary electrical contact 185*c* and at the timing when the main-body side electrical contact 400 is isolated from the rotary electrical contact 185*c* (refer to FIG. 8). In other words, the developing voltage is not positively changed.

The developing voltage when the developing roller 182 passes along the developing position in the position detection sequence is referred to as the second developing voltage for description. The developing voltage before the rotary electrical contact 185*d* for supplying power to the developing roller 182*d* is in the contact state with the main-body side electrical contact 400 is referred to as a sixth developing voltage. The developing voltage before the rotary electrical contact 185*d* for supplying power to the developing roller 182*d* is in the non-contact state with the main-body side electrical contact 400 after the developing roller 182*d* passes along the developing position is referred to as a seventh developing voltage.

The difference between the second developing voltage and the sixth developing voltage and the difference between the second developing voltage and the seventh developing voltage are referred to as a second difference in voltage.

In this case, the first difference in voltage is caused to be larger than the second difference in voltage. The first difference in voltage can be made larger than the second difference in voltage because the position of the rotary 102 is known and the developing voltage can be positively changed.

As described above, the developing voltage can be differently controlled in the case in which the position of the rotary 102 is known and in the case in which the position of the rotary 102 is unknown to prevent the contact between the electrical contacts in the energized state and to suppress the transfer of the developer to the photosensitive drum 2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-288472 filed Dec. 18, 2009 and No. 2010-205833 filed Sep. 14, 2010, which are hereby incorporated by reference herein in their entirety.

What is claimed is:

1. An image forming apparatus comprising:

a main body;

a rotatable image bearing member configured to bear an electrostatic latent image;

a charge unit configured to charge the image bearing member;

a plurality of developing units each including a developer bearing member that bears developer used for developing the electrostatic latent image;

a rotatable developing unit support configured to support the plurality of developing units, the developing unit support being rotated to move each developing unit to a developing position where the developing unit opposes the image bearing member for developing, the developing unit support including support side electrical contacts at which a bias is applied to the developer bearing members provided in the corresponding developing units;

a stop position detecting unit configured to detect a stop position of the developing unit support;

a main-body side electrical contact configured to apply a bias to each of the support side electrical contacts in a state in which the main-body side electrical contact is in contact with the support side electrical contact, the main-body side electrical contact being provided in the main body; and a control unit configured to control a bias to be applied to the main-body side electrical contact and a bias to be applied to the charge unit, wherein the voltage of the main-body side electrical contact when each developing unit performs the image formation at the developing position is referred to as a first developing voltage, the voltage of a non-image portion of the image bearing member when the developing unit performs the image formation at the developing position is referred to as a first image bearing member voltage, and the image forming apparatus is capable of performing a position detection sequence in which the developing unit support is rotated to move the developing unit support to a normal stop position by the stop position detecting unit, and wherein the voltage of the main-body side electrical contact when each developing unit passes along the developing position in the position detection sequence is referred to as a second developing voltage, the voltage of the image bearing member when the developing unit passes along the developing position in the position detection sequence is referred to as a second image bearing member voltage, and the control unit controls the bias to be applied to the main-body side electrical contact and the bias to be applied to the charge unit so that the second developing voltage has the same polarity as that of the first developing voltage and has an absolute value smaller than that of the first developing voltage, the second image bearing member voltage has the same polarity as that of the first image bearing member voltage and has an absolute value smaller than that of the first image bearing member voltage, and the difference between the second developing voltage and the second image bearing member voltage is larger than that between the first developing voltage and the first image bearing member voltage.

2. The image forming apparatus according to claim 1, wherein the plurality of developing units include a first developing unit and a second developing unit arranged downstream of the first developing unit with respect to the rotation direction of the developing unit support, wherein the image forming apparatus is capable of performing an image formation sequence in which the developing unit support is rotated in a state where the developing unit support stops at the normal stop position to cause the first developing unit to pass along without performing the image formation in the first developing unit and the image formation is performed in the second developing unit used as the developing position, and wherein the voltage of the main-body side electrical contact when the first developing unit passes along the developing position in the image formation sequence is referred to as a third developing voltage, the voltage of the image bearing member when the first developing unit passes along the developing position in the image formation sequence is referred to as a third image bearing member voltage, and the control unit controls the bias to be applied to the main-body side electrical contact and the bias to be applied to the charge unit so that the third developing voltage has the same polarity as that of the second developing voltage and has an absolute value larger than that of the second developing voltage, the third image bearing member voltage has the same polarity as that of the second image bearing member voltage and has an absolute value larger than that of the second image bearing member voltage, the difference between the third developing voltage and the third image bearing member voltage is larger than that between the first developing voltage and the first image bearing member voltage.

3. The image forming apparatus according to claim 1, wherein the second developing voltage is equal to zero.

4. The image forming apparatus according to claim 1, wherein the control unit causes the difference between the second developing voltage and the second image bearing member voltage to be larger than the difference between the first developing voltage and the first image bearing member voltage.

5. The image forming apparatus according to claim 1, wherein the position detection sequence is performed when the image forming apparatus is turned on.

6. The image forming apparatus according to claim 1, wherein each developing unit is removable from the main body, the developing unit includes a door that is provided in the main body to allow the developing unit to be removable and a detecting unit that detects the open and close states of the door, and the position detection sequence is performed when the door is changed from the open state to the close state by the detecting unit.

7. An image forming apparatus comprising:

a main body;

a rotatable image bearing member configured to bear an electrostatic latent image;

a charge unit configured to charge the image bearing member;

a plurality of developing units each including a developer bearing member that bears developer used for developing the electrostatic latent image;

a rotatable developing unit support configured to support the plurality of developing units, the developing unit support being rotated to move each developing unit to a developing position where the developing unit opposes the image bearing member for developing, the developing unit support including a plurality of support side electrical contacts at which a bias is applied to the developer bearing members provided in the corresponding developing units;

a stop position detecting unit configured to detect a stop position of the developing unit support;

a main-body side electrical contact configured to apply a bias to each of the support side electrical contacts in a state in which the main-body side electrical contact is in contact with the support side electrical contact, the main-body side electrical contact being provided in the main body, the rotation of the developing unit support allowing the main-body side electrical contact to be in a contact state and in a non-contact state with each of the support side electrical contacts; and a control unit configured to control a bias to be applied to the main-body side electrical contact and a bias to be applied to the charge unit, wherein the image forming apparatus is capable of performing a position detection sequence and an image formation sequence, wherein, in the position detection sequence, the developing unit support is rotated to move the developing unit support to a normal stop position by the stop position detecting unit, wherein the plurality of developing units include a first developing unit and a second developing unit arranged downstream of the first developing unit with respect to the rotation direction of the developing unit support and, in the image formation sequence, the developing unit support is rotated in a state where the developing unit support stops at the normal stop position to cause the first developing unit to pass along without performing the image formation in the first developing unit and the image formation is performed in the second developing unit used as the developing position, wherein, in the image formation sequence, the voltage of the bias to be applied to the main-body side electrical contact when the first developing unit passes along the developing position has an absolute value that is larger than that of the voltage of the bias to be applied to the main-body side electrical contact before a first support side electrical contact at which power is supplied to the first developing unit becomes in the contact state with the main-body side electrical contact and that of the voltage of the bias to be applied to the main-body side electrical contact before the support side electrical contact becomes in the non-contact state with the main-body side electrical contact after the first developing unit passes along the developing position, and wherein the control unit controls the bias to be applied to the main-body side electrical contact and the bias to be applied to the charge unit so that a first difference in voltage is larger than a second difference in voltage, where the first difference in voltage includes the difference between the voltage of the bias to be applied to the main-body side electrical contact when the first developing unit passes along the developing position and the voltage of the bias to be applied to the main-body side electrical contact before the first support side electrical contact at which power is supplied to the first developing unit becomes in the contact state with the main-body side electrical contact and the difference between the voltage of the bias to be applied to the main-body side electrical contact when the first developing unit passes along the developing position and the voltage of the bias to be applied to the main-body side electrical contact before the first support side electrical contact becomes in the non-contact state with the main-body side electrical contact after the first developing unit passes along the developing position in the image formation sequence, where the second difference in voltage includes the difference between the voltage of the bias to be applied to the main-body side electrical contact when the developing unit passes along the developing position and the voltage of the bias to be applied to the main-body side electrical contact before the support side electrical contact at which power is supplied to the developing unit becomes in the contact state with the main-body side electrical contact and the difference between the voltage of the bias to be applied to the main-body side electrical contact when the developing unit passes along the developing position and the voltage of the bias to be applied to the main-body side electrical contact before the support side electrical contact becomes in the non-contact state with the main-body side electrical contact after the developing unit passes along the developing position in the position detection sequence.

8. The image forming apparatus according to claim 7, wherein, in the position detection sequence, the voltage of the main-body side electrical contact when each developing unit passes along the developing position is caused to be equal to the voltage of the main-body side electrical contact before the support side electrical contact at which power is supplied to the developing unit becomes in the contact state with the main-body side electrical contact and to the voltage of the main-body side electrical contact before the support side electrical contact becomes in the non-contact state with the main-body side electrical contact after the developing unit passes along the developing position.

9. The image forming apparatus according to claim 7, wherein the voltage of the main-body side electrical contact when each developing unit performs the image formation at the developing position is referred to as a first developing voltage, the voltage of a non-image portion of the image bearing member when the developing unit performs the image formation at the developing position is referred to as a first image bearing member voltage, the voltage of the main-body side electrical contact when the developing unit passes along the developing position in the position detection sequence is referred to as a second developing voltage, the voltage of the non-image portion of the image bearing member when the developing unit passes along the developing position in the position detection sequence is referred to as a second image bearing member voltage, the voltage of the main-body side electrical contact when the first developing unit passes along the developing position in the image formation sequence is referred to as a third developing voltage, the voltage of the non-image portion of the image bearing member when the first developing unit passes along the developing position in the image formation sequence is referred to as a third image bearing member voltage, and the control unit controls the bias to be applied to the developer bearing member and the bias to be applied to the charge unit so that the second developing voltage has the same polarity as that of the first developing voltage and has an absolute value smaller than that of the first developing voltage, the second image bearing member voltage has the same polarity as that of the first image bearing member voltage and has an absolute value smaller than that of the first image bearing member voltage, the difference between the second developing voltage and the second image bearing member voltage is larger than that between the first developing voltage and the first image bearing member voltage, the third developing voltage has the same polarity as that of the second developing voltage and has an absolute value larger than that of the second developing voltage, the third image bearing member voltage has the same polarity as that of the second image bearing member voltage and has an absolute value larger than that of the second image bearing member voltage, and the difference between the third developing voltage and the third image bearing member voltage is larger than that between the first developing voltage and the first image bearing member voltage.

10. The image forming apparatus according to claim 9, wherein the second developing voltage is equal to zero.

11. The image forming apparatus according to claim 9, wherein the control unit causes the difference between the second developing voltage and the second image bearing member voltage to be larger than the difference between the first developing voltage and the first image bearing member voltage.

12. The image forming apparatus according to claim 7, wherein the position detection sequence is performed when the image forming apparatus is turned on.

13. The image forming apparatus according to claim 7, wherein each developing unit is removable from the main body, the developing unit includes a door that is provided in the main body to allow the developing unit to be removable and a detecting unit that detects the open and close states of the door, and the position detection sequence is performed when the door is changed from the open state to the close state by the detecting unit.

* * * * *